United States Patent [19]

Bowen et al.

[11] Patent Number: 4,814,571

[45] Date of Patent: Mar. 21, 1989

[54] MICROWAVE OVEN ADAPTED FOR UNDER-THE-COUNTER USE

[75] Inventors: Robert F. Bowen, Burlington; Robert E. Wolfe, Millis; Kenneth W. Dudley, Sudbury, all of Mass.

[73] Assignee: Raytheon Company, Lexington, Mass.

[21] Appl. No.: 220,932

[22] Filed: Jun. 23, 1988

Related U.S. Application Data

[63] Continuation of Ser. No. 43,006, Apr. 27, 1987, abandoned.

[51] Int. Cl.[4] ..... H05B 6/76

[52] U.S. Cl. ..... 219/10.55 R; 219/10.55 D; 219/10.55 E; 126/340

[58] Field of Search ..... 219/10.55 R, 10.55 E, 219/10.55 D, 10.55 A, 10.55 F; 126/340, 339; 312/236

[56] References Cited

U.S. PATENT DOCUMENTS

| | | | |
|---|---|---|---|
| 2,944,540 | 7/1960 | Littell, Jr. | 126/340 X |
| 2,956,144 | 10/1960 | Woodman | 219/10.55 R |
| 2,993,973 | 7/1961 | Johnson et al. | 219/10.55 R |
| 3,440,385 | 4/1969 | Smith | 219/10.55 R |
| 3,537,390 | 11/1970 | Hinkel, et al. . | |
| 3,758,737 | 11/1973 | Ironfield | 219/10.55 R |
| 3,767,884 | 10/1973 | Osepchuk, et al. | 219/10.55 D |
| 4,219,716 | 8/1980 | Kaufman, Jr. et al. | 219/10.55 R |
| 4,313,043 | 1/1982 | White et al. | 219/10.55 R |
| 4,335,289 | 6/1982 | Smith | 219/10.55 F |
| 4,335,292 | 6/1982 | Tanaka et al. | 219/10.55 R X |
| 4,349,713 | 9/1982 | Marsen | 219/10.55 R X |
| 4,371,770 | 2/1983 | Gilliatt | 219/10.55 D |
| 4,390,767 | 6/1983 | Bucksbaum, et al. | 219/10.55 D |
| 4,390,768 | 6/1983 | Teich, et al. | 219/10.55 R |
| 4,413,168 | 11/1983 | Teich | 219/10.55 B |
| 4,431,888 | 2/1984 | Simpson | 219/10.55 F |
| 4,596,915 | 6/1986 | Simpson | 219/10.55 F |

OTHER PUBLICATIONS

"Cook Capsule RE-1", Sharp Company; p. 6.

*Primary Examiner*—Philip H. Leung
*Attorney, Agent, or Firm*—Richard M. Sharkansky; William R. Clark

[57] ABSTRACT

A microwave oven adapted for under-counter use that eliminates many of the disadvantages of prior microwave ovens. A bottom member and transparent canopy shaped top member or cover from a microwave conductive cavity viewable from three or more sides. The botton and top members may be hinged or slidably connected to provide maximum cavity access for food insertion. By mounting the oven on slides in a kitchen cabinet, drawer, or appliance enclosure, the oven is kept out of sight and out of the way when not in use but quickly available when needed. Lighting, venting, and viewing of the cavity and its contents is simpler, safer, easy and efficient.

21 Claims, 8 Drawing Sheets

MICROWAVE OVEN ADAPTED FOR UNDER-THE-COUNTER USE

This application is a continuation of application Ser. No. 043,006 filed Apr. 27, 1987, now abandoned.

BACKGROUND OF THE INVENTION

A well known drawback of a domestic countertop microwave oven is that it takes up a significant amount of the available countertop space. In fact, many homes simply do not have enough counter space to accommodate a microwave oven large enough to cook a meal. Some ways to solve this problem are to use a stand or other furniture for separately supporting the microwave oven, or for the domestic user to purchase a countertop microwave oven that is to small that it will only hold a cup of soup or similar small items. Some manufacturers have had great success in selling microwave ovens that mount underneath an overhead cabinet such that they are suspended above the counter or a range. Generally, these cabinet mounted microwave ovens are smaller than full size, are somewhat difficult to access, detract from the usefulness of the counter space underneath them, and are considered by some to give a cluttered appearance. Further, with many other appliances such as can openers, toasters, etc. being mounted underneath the overhead cabinets, there is now even competition for this space as well.

A small countertop microwave oven seen in some countries, such as Japan, is the dome microwave oven. The dome oven typically includes a base member having a microwave energy generator disposed therein and operating controls along the front edge. A dome-shaped cover is attached to the base via a rear hinge member. Sometimes the base member must be steadied with one hand while the dome is opened with another hand. Venting of this oven has been found to be difficult. Vent holes cannot be placed in the dome because foreign objects such as metal wires could either accidentally or purposefully be inserted into the cavity, thus resulting in leakage of microwave energy. Further if vent holes are positioned in the base member, they would tend to become clogged with spilled food. The dome cover requires bending material along several axes during manufacture, and thus is expensive to fabricate. The Cook Capsule RE-1 sold by Sharp Company is a dome microwave oven.

Conventional thermal ovens are typically mounted below the countertop level in either a free standing or built-in arrangement. Also, some of these thermal ovens have the capability of simultaneously cooking with microwave energy; they have been referred to as common cavity or combination ovens. These ovens generally have a bottom hinged door that opens downwardly.

SUMMARY OF THE INVENTION

The objects of this invention include providing an easy to use microwave oven that can be located beneath a kitchen counter. The oven should not only be capable of being placed completely out of sight if desired, but also be aesthetically pleasing if it is desired to have it remain in view. This oven should be capable of cooking large items. It is desirable for the oven to require only one free hand to open it, insert food, and set operating controls. It should provide maximum viewing of the food while cooking without the need to bend over or interrupt operation. The oven should be easy to manufacture and safe to use.

These and other objects are provided by a microwave oven featuring a bottom member, a top member shaped to complete a cavity with the bottom member and means for slidably mounting the top and bottom members.

The top member can be embodied as a canopy shaped cover to provide maximum accessibility to the cavity when inserting food. It can be made light-transparent on three or more sides to provide maximum viewing of food being cooked. Such a cover may also be hinged to the bottom member. The bottom member can include a depressed food holding tray to assist with containing spills.

The oven can be adapted in various ways to fit underneath a kitchen counter. One way is to provide slides for connecting to the inner walls of an under-counter cabinet. Either the top or bottom member can remain fixed while the other member slides. The oven is opened by pulling on the sliding member, much as a conventional cabinet drawer is pulled out. Also, the fixed member can be mounted on a pedestal which is mounted on the floor; in this way, there can be greater width tolerance because the unit is supported from the floor underneath rather than the lateral sides of the cabinet.

The oven can also be adapted to fit in a top drawer or drawers of an existing kitchen cabinet or be sold as a stand-alone unit where the bottom member and a connected front member horizontally slide out to provide access to the cavity.

The cover may also be hinged to the bottom member or formed in several pieces.

There are many advantages to this invention. By simply pulling on the sliding member, the cavity is is open on several sides. This provides good access and the cooking cavity is easily viewed. The sliding member is easily returned to the closed position to provide a sealed cavity safe from leaking microwave energy. There is no need to find a place to store a cover because when the slidable member is open, the cover can be slid back under the counter. Also there is no need to steady the bottom unit when opening the canopy. The unit is solidly mounted underneath the counter to a kitchen cabinet or other firmly mounted enclosure.

Lighting and venting of the cavity is simple and more efficient since neither of these functions need be associated with a dome, a cover, or cooking surfaces. The depressed tray provides means for containing spills.

The transparent canopy shaped cover allows a full range of viewing, an improvement over a conventional countertop microwave oven that has only a windowed door on the front. More specifically, with a door, the food can only be viewed from the front, but with a transparent canopy, the food can be viewed from the top and both sides.

The cover can be made removable and thus the oven is easily cleaned. The cover is formable with a single gradual bend or only two bends along parallel axes, and thus is simpler and less expensive to manufacture than domes. Because the front wall of the cavity is away from the cooking surface, vent holes can conveniently be placed there, out of reach.

BRIEF DESCRIPTION OF THE DRAWINGS

These and other objects, features, and advantages become evident from examination of the following detailed description when read in connection with the accompanying drawings where.

DETAILED DESCRIPTION OF THE PREFERRED EMBODIMENTS

Figure 1:
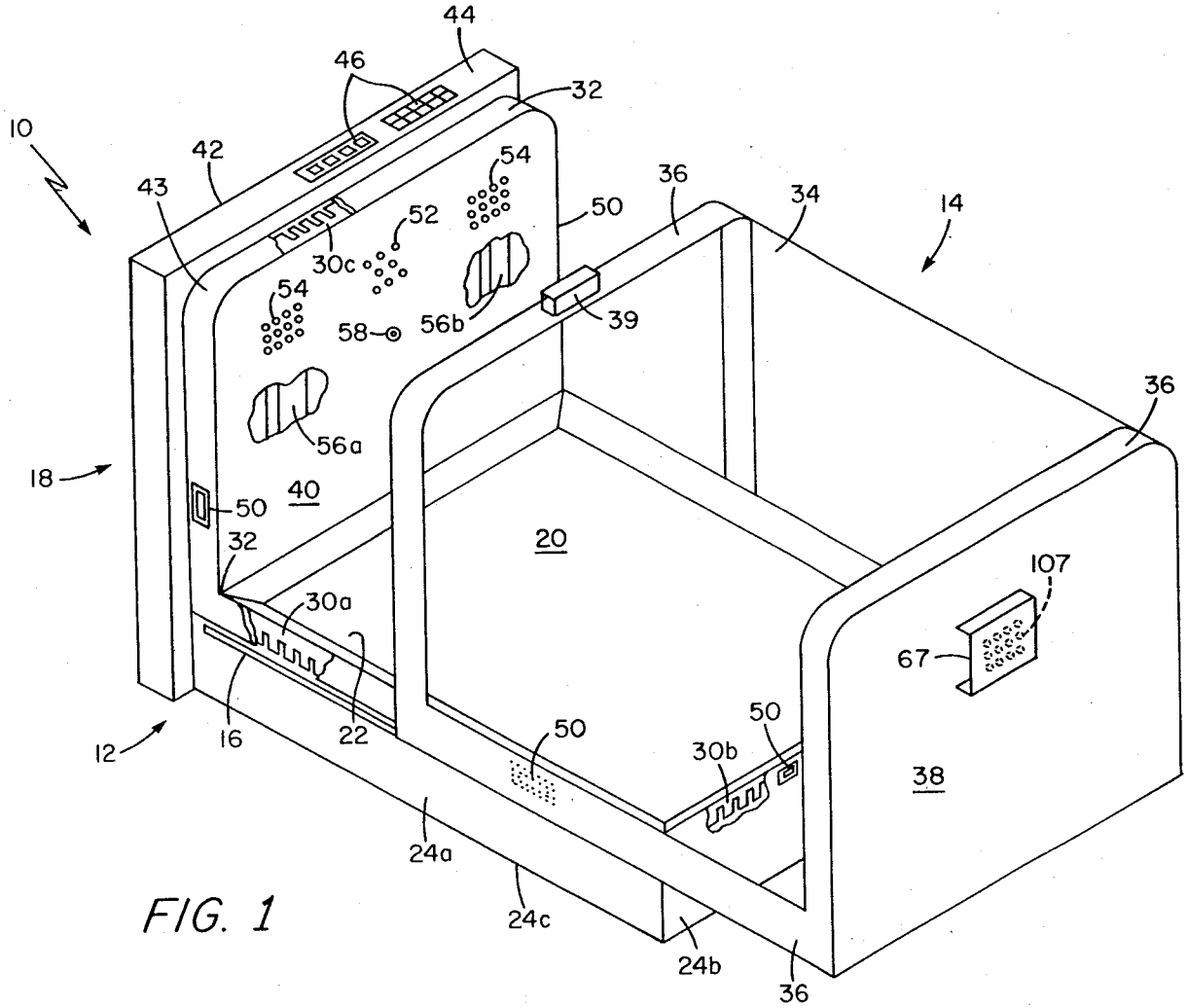
FIG. 1 is a rear isometric view of a microwave oven according to the present invention.

Now referring more particularly to the drawings, where like reference characters designate corresponding parts throughout the several views, the invention is shown in FIG. 1 as a microwave oven 10 comprising a horizontal bottom member 12, a top member embodied as a cover 14 and slidable mounting means 16 disposed between the bottom member 12 and cover 14. When cover 14 is placed in a closed position up against a vertical front member 18, cover 14, front member 18, and bottom member 12 form an enclosed conductive cavity 20 sufficient for containing microwave radiation.

Bottom member 12 is preferably box-like, and, as will be described in detail with reference to FIG. 3, includes components feeding microwave energy into cavity 20. Bottom member 12 also includes a tray 22, sides 24*a* and 24*d*, bottom panel 24*c* and back 24*b*. Tray 22 serves to hold the food to be cooked as well as for containing spills. A central portion of tray 22 may be depressed by forming it with upward-bent peripheral edges where it contacts the sides 24*a* and 24*d* and back 24*b*. Tray 22 is fabricated of a microwave transparent material such as ceramic so that the microwave energy can feed up through tray 22 from the underside. Metal sides 24*a*, 24*d*, and back 24*b* are sufficiently strong to support tray 22 and cover 14. A slide 16 is positioned along sides 24*a* and 24*d* and connects to cover 14. In order to provide sufficient safety against leakage of microwave radiation as required by the government, a microwave seal or choke 30, such as that indicated by numerals 30*a*, 30*b*, and 30*c*, is disposed along the area where canopy 14 contacts bottom member 12 and front member 18. The microwave seal 30 may be continuous or formed of separate pieces. The microwave seal 30 is shown in detail in FIG. 2. A seal liner 32 preferably made of a microwave transparent plastic is positioned along the microwave seal 30 to provide a smooth bearing surface for cover 14, to regulate the spacing between seal 30 and cover 14, and to keep food particles from falling into the seal 30. Seal liner 32 also serves to hide the seal 30, thereby making the microwave oven 10 more aesthetically pleasing.

Cover 14 is seen to be preferably shaped as a canopy including a laminated transparent radio frequency shield 34. Shield 34 is formed from a perforated metal sheet or screen having sufficient perforation spacing to allow viewing of food placed within cavity 20, while also appearing as a solid metal surface to microwave radiation contained in cavity 20. The inner and outer layers of the screen are covered with a transparent plastic sheet such as polycarbonate. The plastic sheet is sufficiently resilient to withstand knocking about in use and temperant to withstand the temperature to which cavity 20 may rise during cooking operations. Furthermore, cover 14 here includes a metallic frame 36 surrounding and containing transparent shield 34. Both frame 36 and transparent shield 34 are preferred to be arched in cross-section. The arched cross-section may be provided by making two bends in transparent shield 34 and frame 36 along opposing axes 37*a* and 37*b* or by one continuous bend along a central axis to provide a semi-circular cross-section. A metallic back member 38 completes cover 14 in the embodiment shown. A pull or handle 39 is perferably attached to a top region of the forward portion of frame 36 to assist with sliding the cover 14 back and forth along slide 16.

Box-like front member 18, or tower positioned perpendicularly to bottom member 12, includes at least an inside rearfacing wall 40 and an outside forward-facing wall 42. Inside wall 40 can be integrally formed with one or more portions of bottom member 12. Front member 18 also includes a top surface 44. A control panel and display 46 is shown located in the top surface 44 where it is convenient for the user to access it. Control panel and display 46 are connected to control electronics (not shown) used to control the components feeding microwave energy to cavity 20. A ridge 43 is preferably formed near the top 44 and side surfaces of front member 18. Ridge 43 is shaped to engage an inside forward portion of under cavity 20.

Other features of microwave oven 10 include interlock switches 50. Two interlock switches 50 are shown adjacent opposing portions of ridge 43 in front member 18. Interlock switch 50 is also shown adjacent side 24*a* of bottom member 12. Another possible position for an interlock 50 is shown at back wall 24*b* of bottom member 12. Interlock switches 50 provide an electrical open circuit when cover 14 is slid away from front member 18 and an electrical closed circuit when cover 14 is slid forward adjacent front member 18. Interlock switches 50 are electrically connected to the control electronics so that all are closed before power is applied to the microwave energy feed (not shown). Government regulations typically require at least three interlock switch locations to insure that oven 10 does not operate unless cavity 20 is sealed. Interlocks 50 can also be arranged to cause power to the microwave feed to be cut when interlocks 50 fail. Interlock 50 should be placed away from choke 30 or in other such fashion as to not interfere with choke 30 operation.

Also shown in inside wall 40 are light h les 52 allow light from a light source (not shown) mounted inside front member 18 to enter and illuminate cavity 20. Light holes 52 are sufficiently large to allow light to pass through but sufficiently small to keep microwave radiation inside cavity 20 from entering front member 18. Similarly sized vent holes 54, preferably disposed on either side of light holes 52, provide access to cavity 20 for venting. Portions of inside wall 40 have been broken away in the drawing to reveal an intake duct 56a and exhaust duct 56b that respectively provide and remove air from cavity 20 when microwave oven 10 is operating. A temperature probe connector 58 may be positioned in inside wall 40 to provide a way to connect a temperature probe between the food and the control electronics.

In operation, the user typically opens cavity 20 by grasping cover 14 at its handle 39 and pushing it back along slides 16. Food is then placed inside cavity 20 on tray 22. Cavity 20 is then closed by sliding cover 14 back along slides 16, up against ridge 43 sufficient far to cause interlock switches 50 to be closed. Cooking time, temperature, and power levels are then selected via control panel and display 46. The food may be viewed during cooking merely by glancing through the transparent shield 34 on its top or sides without bending over or interrupting the operation of microwave oven 10.

Figure 2:
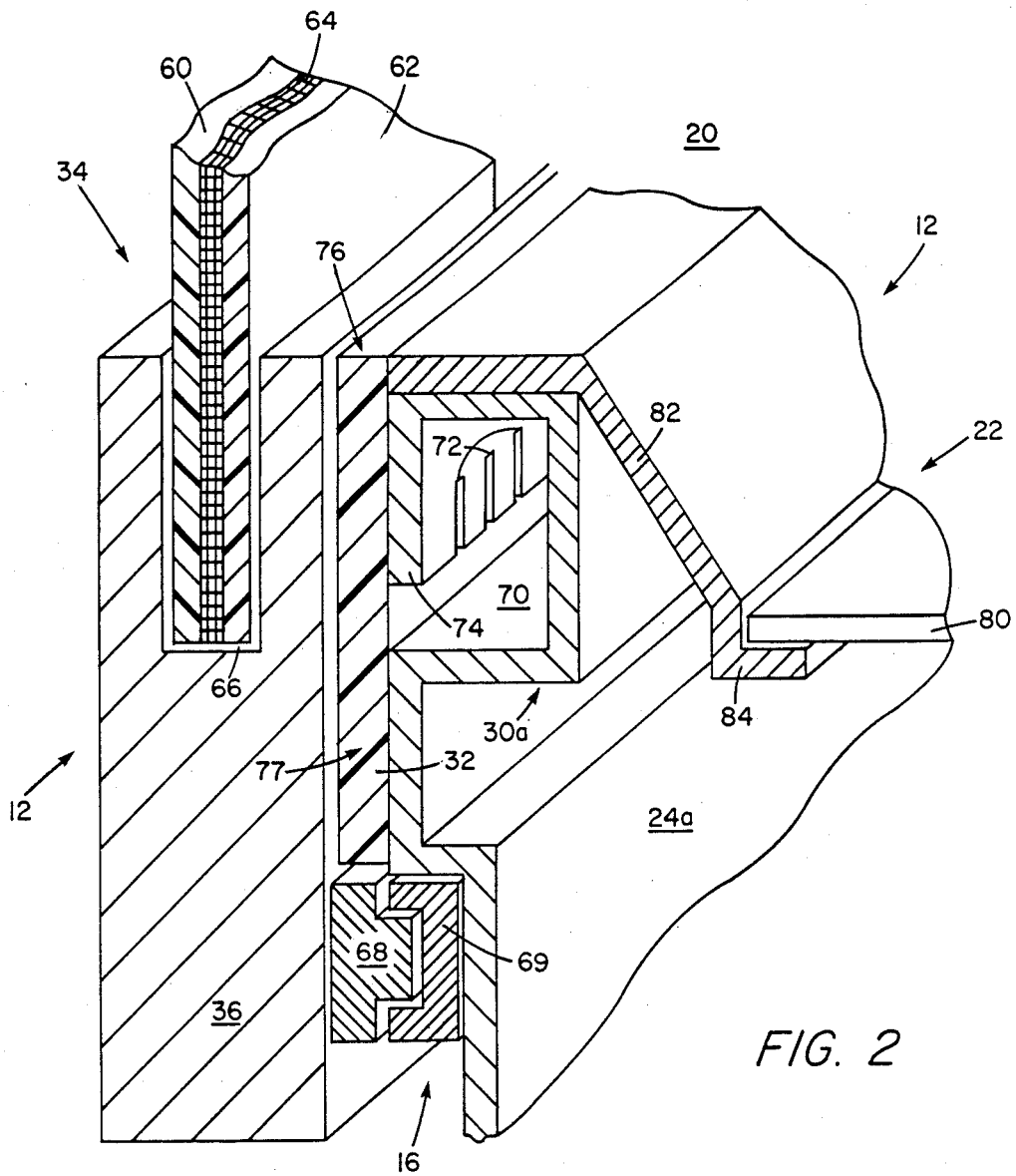
FIG. 2 is a closer cutaway isometric view of a bottom member, canopy, and slide associated with one embodiment of the microwave oven of FIG. 1.

FIG. 2 shows an isometric cutaway view of a portion of bottom member 12, cover 14, and slide 16 looking along side wall 24a. The view is looking forward so cavity 20 appears above and to the right of the parts shown. Side wall 24a of bottom 12 is seen to have several 90° bends formed along its upper portion. These serve to accommodate slide 16 as well as to provide structure for forming microwave seal 30. As seen, a portion of frame 36 extends from cavity 20 down to a middle section of side wall 24a.

Transparent shield 34 is shown to be formed of outer and inner plastic sheets 60 and 62 surrounding a perforated metal sheet or screen 64. Transparent shield 34 can be formed by laminating, flowing plastic over and through screen 64 by insertion molding, lay up, or other suitable technique. Transparent shield 34 may be attached to frame 36 by an engaging slot 66 formed along the inside periphery of frame 36.

Slide 16 is of any convenient type such as that having two rail members 68 and 69. One rail member 68 is mounted along the lower edge of frame 36. The other rail member 69 is mounted along a middle portion of side 24a. Various other types of slides having rollers or ball bearings may also be used. As shown, side 24a may be indented where rail 69 is mounted to provide proper spacing between side 24a and frame 36 and/or can be adjusted using shims (not shown) when being installed.

Microwave seal or choke 30a may be formed by appropriate bending and cutting of wall 24a or as a separate metal piece attached to wall 24a. The microwave choke 30a could also be formed in the walls of canopy 14 rather than in bottom member 12. Here, choke 30a is seen to comprise a reentrant choke cavity 70 well known in the art. Such reentrant chokes are characterized by a common wall 74 positioned between the choke cavity 70 and an input section 76 and output section 77 formed where energy tries to escape from cavity 20. Choke liner 32, here shown to be disposed in the input section 76 and the output section 77, may also be used to fill the choke cavity 70. Choke cover or liner 32 is formed of a material with a dielectric constant such that it does not interfere with the operation of choke 30a. In operation, microwave radiation enters choke 30a from cavity 20 via input section 76 and propogates down until reaching choke cavity 70. Choke cavity 70, which has a depth of approximately one-quarter wavelength, transforms an open circuit in series between the input section 76 and the output section 77, thus reflecting microwave energy back towards cavity 20. Slots 72, disposed outwardly in common wall 74, inhibit orthogonal propogation so that all of the microwave energy propogates in a single mode that is effectively reflected by choke cavity 70.

Also shown with more detail is tray 22. It preferably comprises a ceramic plate 80 supported by a metallic collar 82 or flange. Plate 80 is sealed and securely held in place on collar 82 by a high temperature silicone material (not shown). Collar 82 is attached along the upper end of side wall 24a and has several downward bends to provide a lip 84 at a position beneath the upper edge of side wall 24a. Lip 84 serves to depress ceramic plate 80. Spills are thus contained by having this collar 82 surround ceramic plate 80.

Figure 3:
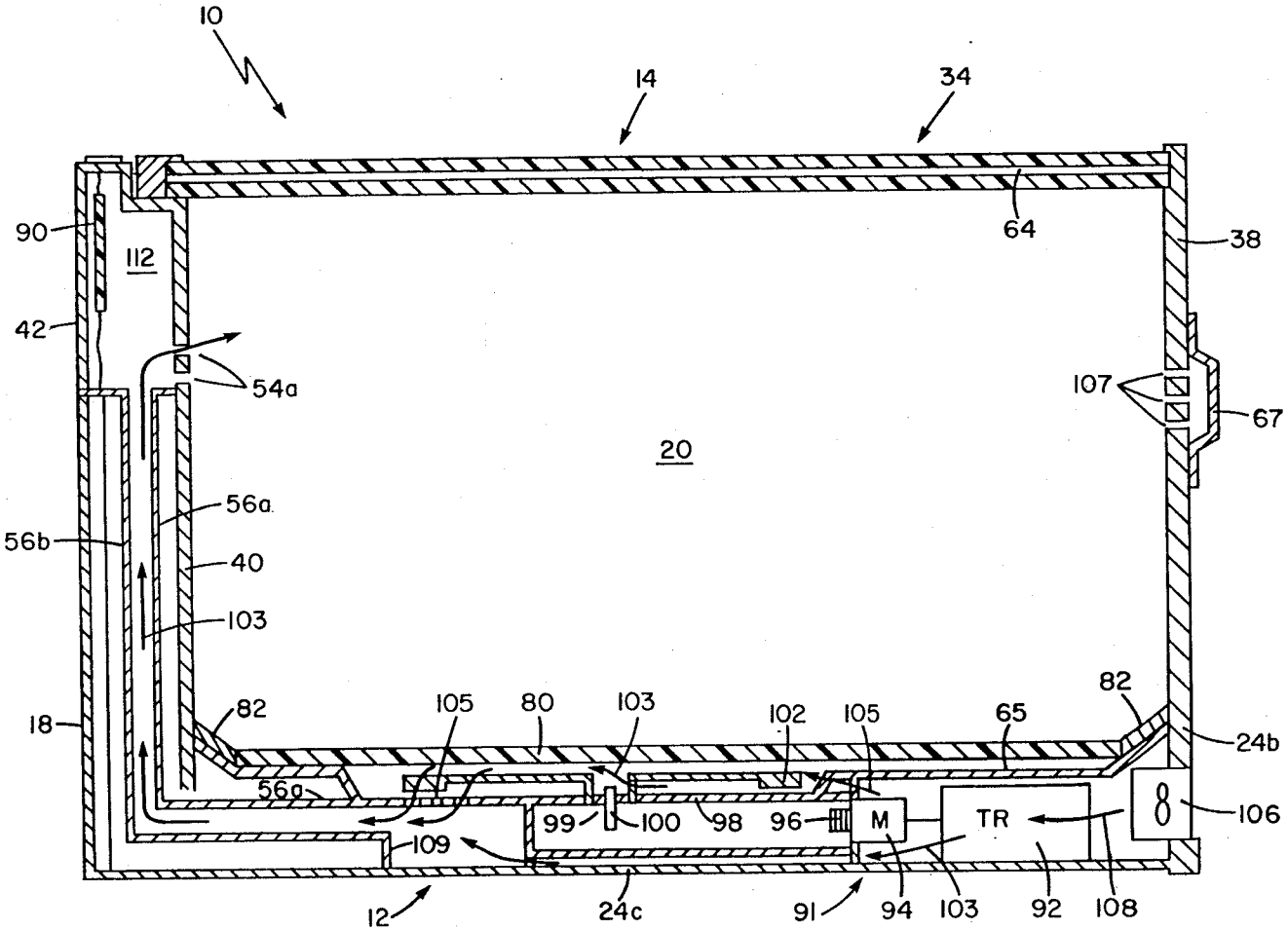
FIG. 3 is a vertical section of the microwave oven taken along a central axis and showing one possible arrangement of its various operating components.

FIG. 3 is a side sectioned view of microwave oven 10. Microwave conductive cavity 20 is formed by surrounding conductive members including cover 14, having the perforated metal sheet 64 of transparent shield 34 and the back wall 38, floor 65 with bottom member 12, and inside wall 40 of front member 18. Control electronics 90 may be mounted inside front member 18 behind outside wall 42, beneath and connected to control panel and display 46. Control electronics 90 are also connected to a power source and interlock switches 50 (FIG. 1) as well as transformer 92 (connection not shown for clarity). In operation, upon instructions from the user via control panel and display 46, control electronics 90 provide electrical signals to control a microwave feed 91 causing it to energize a magnetron 94. Microwave feed 91 includes a transformer 92, a magnetron 94, a waveguide 98, probe 100, and radiating antenna 102. Magnetron 94 provides microwave frequency energy oscillating at a suitable frequency such as 2450 Megahertz at its output probe 96. The energy provided by output probe 96 is contained by waveguide 98. It travels along waveguide 98 to a probe 100, which couples it through an aperture 99 in waveguide 98 to radiating antenna 102. The energy radiating from antenna 102 is directed into and confined within cavity 20. The energy thus fed into cavity 20 causes food placed on ceramic plate 80 to be cooked. This arrangement of microwave radiating elements is meant to be exemplary, as other arrangements are known in the art.

Fan 106 is mounted in the back or bottom of bottom member 12. Although it will be understood that the cooling and venting air could flow in the opposite direction than described, fan 106 here draws air in and blows it into a compartment 108 formed beneath floor 65 of cavity 20 and above bottom panel 24c. The air 103 first flows across transformer 92 and magnetron 94 providing cooling of these components. Next, the air travels around and/or under waveguide 98 and up duct 56a in front member 18. As an alternate or additional path from fan 106 to duct 56a, air 103 may be routed through perforations 105 in floor 65 so as to rotate antenna 102 and provide more uniform heating of the food. Antenna 102 could also be motor driven. From duct 56a, air 103 travels to a second compartment 112 formed in the upper portion of front member 18 where control electronics 90 are located. The moving air then passes along control electronics 90 and enters cavity 20 via vent holes 54a. Air 103 may be exhausted from cavity 20 via exhaust duct 54b or through vent holes 107 in the back wall 38 of canopy 14. The flow of air 103 through cavity 20 removes moisture. Vent hole protector 67 serves to keep foreign objects from entering holes 107.

Figure 4:
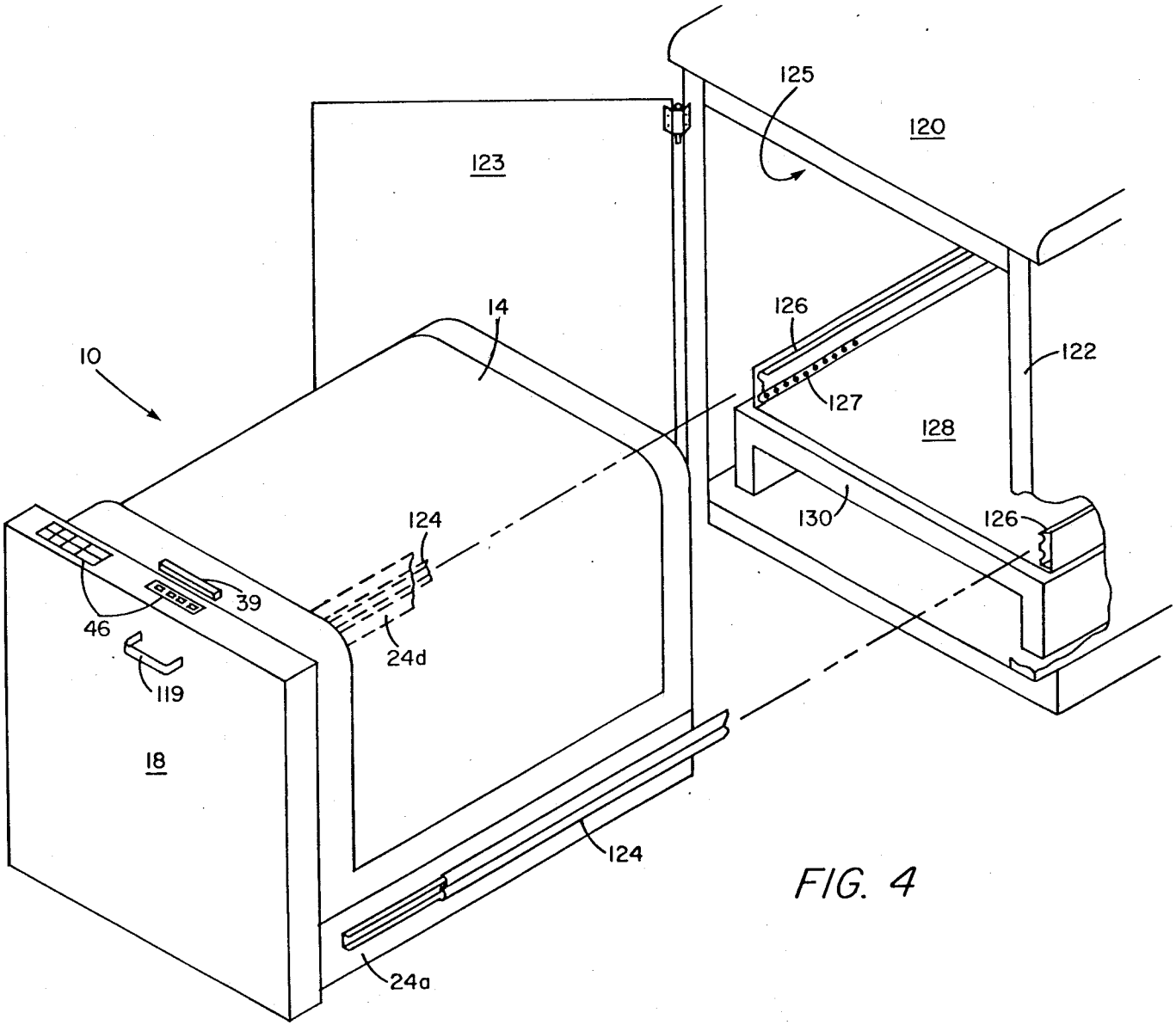
FIG. 4 is one example of how the microwave oven may be mounted in a cabinet underneath a kitchen counter.

FIG. 4 shows one of the various mounting options possible for placing microwave oven 10 beneath a kitchen counter 120. Shown is an under-counter kitchen cabinet 122 having a door 123. Here, slide members 1124 are attached to the bottom of microwave oven 10 along sides 24*a* and 24*d*. Slide members 124 engaged fixed members 126 attached to cabinet 122 in a suitable manner. Given the weight of microwave oven 10, it is preferable that such fixed members 126 are of the type having roller bearings 127. Although kitchen cabinets come in various standard sizes such as two, two and a half, and three feet wide, many cabinets are of varying or non-standard dimensions, and thus, it is impractical to expect that fixed members 126 may be conveniently mounted to the sides of cabinet 122. To solve this problem, they may instead be fixed to a plate 128 formed of a sheet metal or other convenient material. The adapter plate 128 may then be mounted to the sides or bottom of cabinet 122. In the embodiment shown, a wood pedestal 130 is used to support adapter plate 128. In an alternate embodiment, pedestal 130 could be made of metal. Also, pedestal 130 is here shown as an inverted U, and a storage drawer (not shown), for items such as microwave cooking accessories, could be mounted in a suitable manner on the underside thereof. The microwave oven 10 is slid back into cabinet 122 with door 123 closed when not in use. In order to use microwave oven 10, the door 123 is opened, microwave oven 10 is slid out of cabinet 122 by pulling on a handle 119 on front member 18 causing oven 10 to slide out along slide and fixed members 124 and 126. The cover 14 is then slid back by pushing on handle 39. The cover 14 is then completely out of the user's way being back inside under counter cabinet region 125. The food is then placed inside microwave oven 10 on tray 22. As before, the cover 14 is then closed and the oven energized. The oven can be energized in the open position, or it can be energized after it is pushed back under the counter and cabinet door 123 closed.

Figure 5:
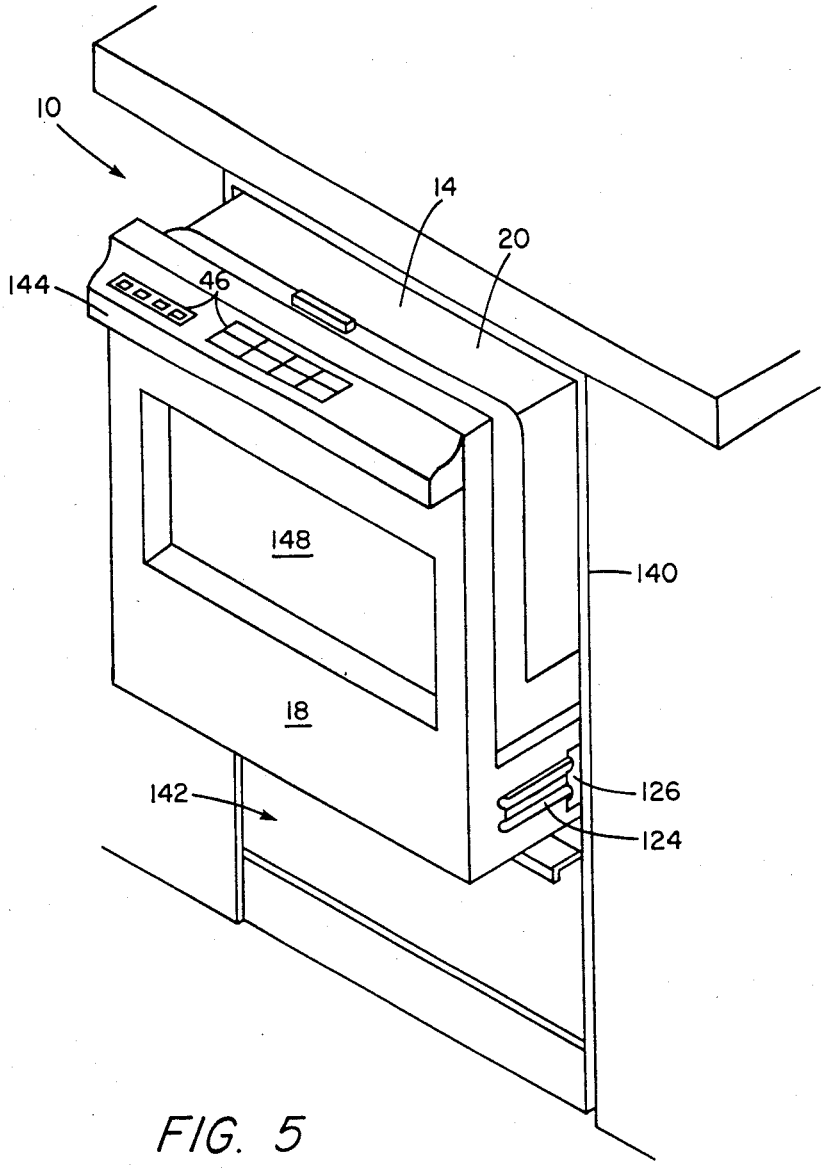
FIG. 5 shows another example of how the microwave oven may be embodied in a separate enclosure adapted for mounting underneath the kitchen counter.

FIG. 5 shows the microwave oven 10 in accordance with this invention embodied as a stand alone under-counter appliance. This appliance includes a metallic under-counter enclosure 140 adapted for being placed underneath kitchen counter 120 like those used for dishwashers, trash compactors, and conventional thermal ovens. As before, slide members 24 are attached to the bottom or sides of microwave oven 10. Fixed members 126 are attached to the inside of enclosure 140. Oven 10 is extracted from enclosure 140 by pulling on a handle 144 formed adjacent to front member 18. Here the handle 144 is integrally molded with front member 18 and has the control and display panel 46 also integrally formed within it. A lower drawer 142 may be provided in the space beneath microwave oven 10 in enclosure 140 for storage of cooking accessories. A front window 148 may be formed in front member 18 to allow viewing of cavity 20 when microwave oven 10 is positioned inside enclosure 140. If front window 148 is used, any ducting and lighting in front member 18 must be moved to the sides of window 148. Microwave oven 10 can be pulled out of enclosure 140 and access provided to cavity 20 and tray 22 in one operation by use of a trigger mechanism 145 and friction retainer mechanism 146. If used, the trigger 145 normally engages the front edge of cover 14 to front member 18. If trigger 145 is squeezed while pulling microwave oven 10 out of enclosure 140, cover 14 is then disconnected from front member 18, thereby allowing friction retainer 146 to retain cover 14 inside enclosure 140 in the position shown by dashed lines 149. Thus, the user may squeeze trigger 145 while pulling on handle 144, to open microwave oven 10 with one hand and insert food to be cooked with another hand. The oven 10 is then shut by simply pushing on handle 144, much as a cabinet drawer is closed. If it is desired to view the progress of the food while cooking, trigger 145 is not squeezed when pulling on handle 144, thereby keeping cover 14 engaged to front member 18 as microwave oven 10 is pulled out of appliance cabinet 140. The figure is also suggestive of another embodiment where cover 14 is actually the ceiling of a fixed cavity 20 and is permanently retained or integrally formed inside appliance cabinet 140, much like will be discussed in FIGS. 7A and 7B.

Figure 6:
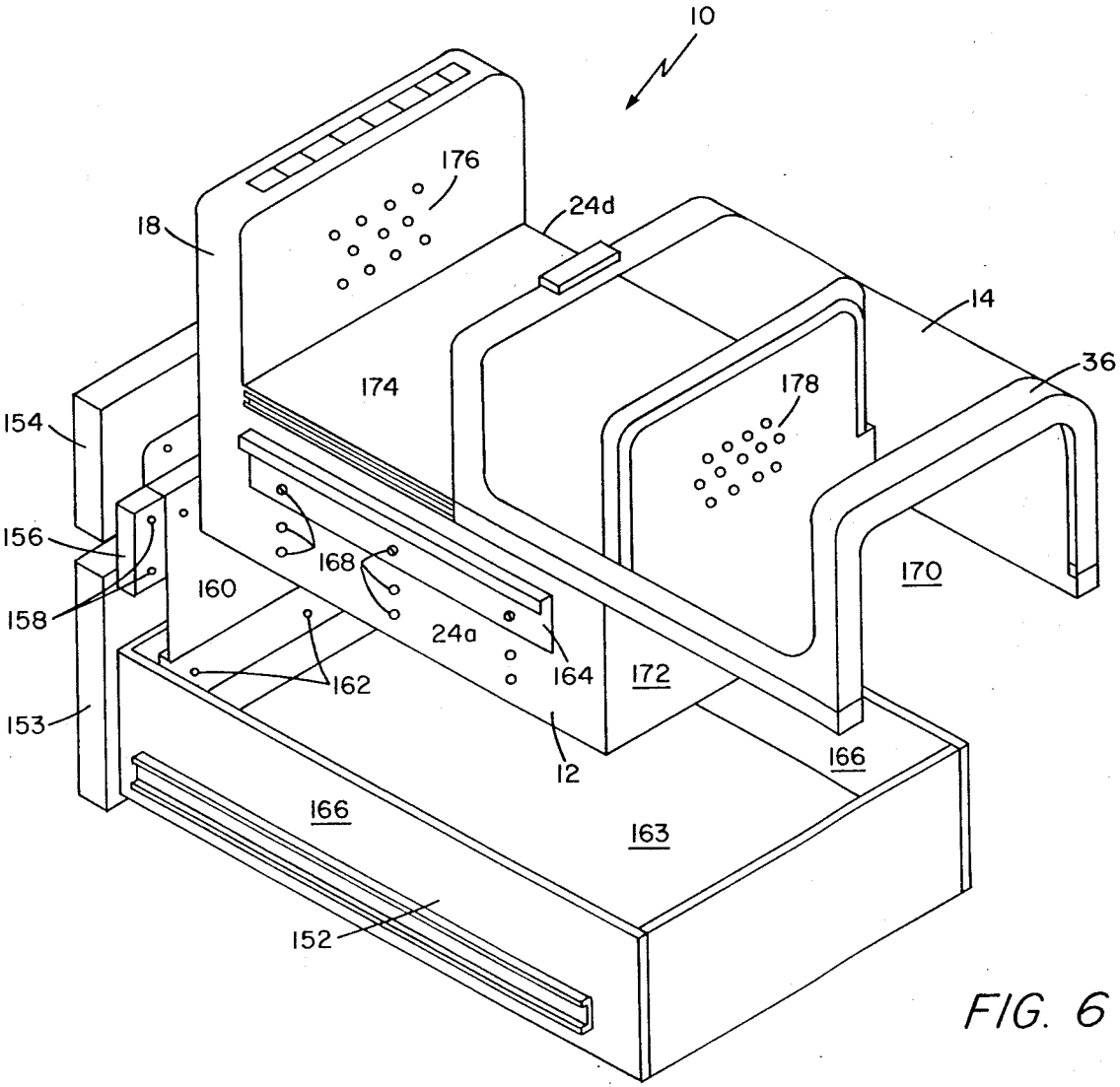
FIG. 6 shows how the microwave oven can be adapted for use in the top drawer or drawers of a conventional kitchen cabinet.

FIG. 6 shows how microwave oven 10 may be placed in a kitchen drawer 152. Drawer 152 includes front 153, sides 166, and bottom 163. Many under-counter kitchen drawers are not large enough to provide sufficient space for a microwave oven, so if need be, another upper drawer front 154 may be removed from a drawer above drawer 152. A drawer separator portion 156 normally part of a kitchen cabinet front may also be removed and fastened between drawer fronts 153 and 154 by appropriate fasteners 158 such as wood screws. If additional support or fastening is desirable, an appropriately shaped adapter plate 160 formed of sheet metal, for example, and having pre-drilled holes may be also used together with additional fasteners 162 to secure drawer fronts 154 and 153. This arrangement provides an aesthetically pleasing view when drawer 152 is closed. Hanging bracket 164 is mounted along sides 24*a* and 24*d* of bottom member 12 by adjustable fastening means 168, such as multiple pre-drilled holes and sheet metal screws. Hanging bracket 164 is adjusted to provide proper clearance between the bottom of microwave oven 10 and drawer 152. Hanging bracket 164 is used to allow microwave oven 10 to rest on the sides 166 of drawer 152. Hanging bracket 164 could be eliminated but it is preferable to keep microwave oven 10 away from the bottom of the drawer to encourage air circulation as well as to keep microwave oven 10 from moving back and forth within drawer 152.

Additionally, the bottom 163 of drawer 152 may not be sufficiently strong to support oven 10. It is desirable for bracket 160 to engage front member 18 in appropriate fashion such as by metal screws, snap locks or by forming tongue and groove joints. This serves to make the drawer 152 more rigid and less susceptible to breaking with misuse.

FIG. 6 also shows various alternate embodiments of microwave oven 10 including a unitary front member 18 and bottom member 12, and a cover 14 having an open back 170 rather than the metal back 38 of the embodiment shown in FIG. 1. In this instance, the back 172 of bottom member 12 is necessarily higher to engage frame 36. The tray 174 here is shown as flat, formed without a collar. This is cheaper to manufacture but provides a cooking surface more susceptible to messy spills. Part of sides 24*a* and 24*b* can be raised to contain spills. Also shown is another embodiment for air venting where a single vent 176 is formed in front member 18 and an exhaust vent 178 is formed in the rear panel 172 of bottom member 12.

Figure 7B:
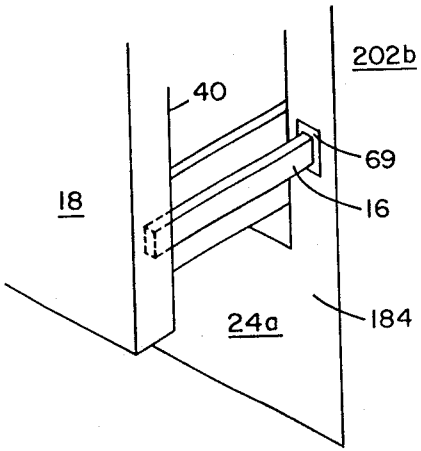
FIGS. 7A and 7B show an alternate embodiment of the microwave oven of FIG. 1.
Figure 7A:
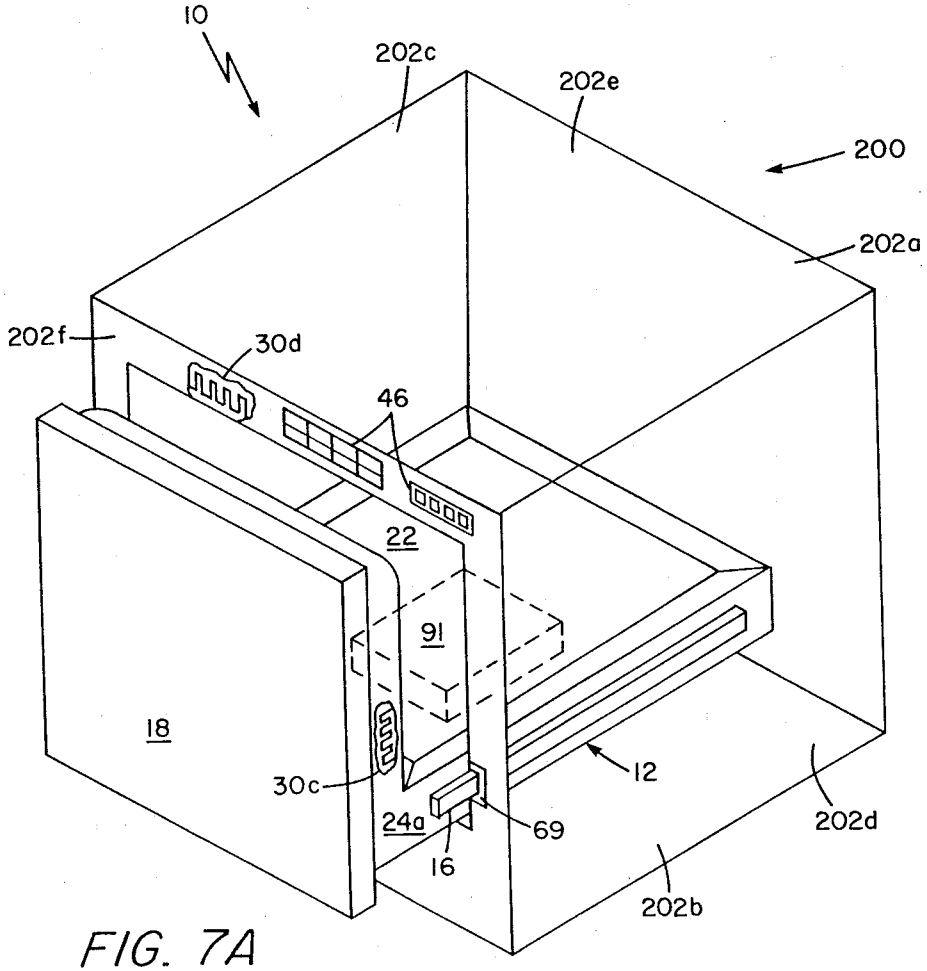

FIG. 7A shows another embodiment of microwave oven 10 where top member 14 is formed instead much as a conventional microwave oven enclosure 200 having five conductive metallic panels including a top panel 202*a*, a bottom panel 202*b*, a left side panel 202*c*, a right side panel 202*d* and rear panel 202*e*. Microwave feed 91 is placed inside enclosure 200 adjacent bottom panel **202*b* but could also be positioned near top panel 202*c*. Bottom member 12 is formed similar to that of the previous figures, with the exception that its bottom panel 24*c* is not used and feed 91 is not contained within. This allows microwave energy from feed 91 to reach food placed on tray 22 by passing through ceramic plate 80 as before, but now feed 91, no longer part of bottom member 12, remains stationary as bottom member 12 is moved back and forth along slides 16. Choke 30 may be formed as before or may also be formed where a front panel 202*f* meets front member 18. Control panel and display 46 can be mounted on a front panel 202*f* of enclosure 200 so wires running from control electronics 90 to feed 91 may remain fixed while bottom member 12 slides. Fixed member 69 of slide 16 may be recessed in the inside surface of panel 202*b*, or as shown in FIG. 7B, be completely positioned inside of panel 202*b*. For this case, moving slide member 68 is attached to rear facing wall 40 of front member 18 rather than sides 24*a* or 24*c*. This allows all inside walls of cavity 20 to be smooth with no irregularities presented as would be when slide 16** is mounted as in FIG. 7A.

Figure 8:
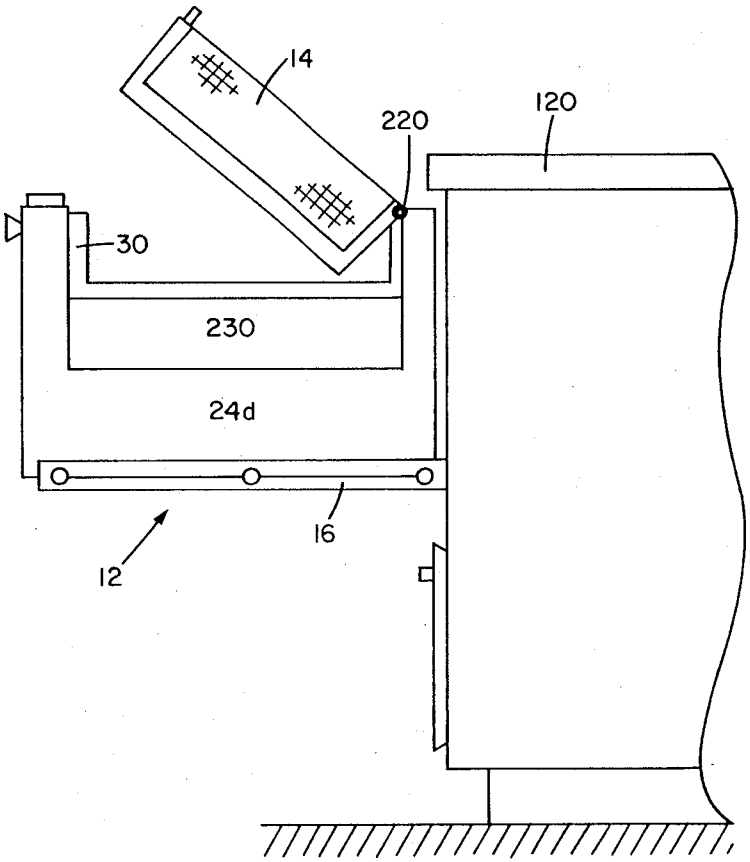
FIG. 8 shows a side view of another alternate embodiment.

FIG. 8 is a side view of another embodiment where cover 14 is connected to bottom member 12 at the rear by hinge 220. Hinge 220 may have a stop to hold cover 14 in an open position. Here, cover 14 is smaller in height than previously discussed embodiments and does not extend down to a point ner tray 22, but only to a midpoint. Rather, side panels 230 of laminated transparent material similar to that used for the shield 34 of cover 14 are positioned on either side of bottom member 12 above side **24*c* and extend from the tray 22 to the midpoint. As shown, seal 30 is part of cover 14 rather than bottom member 12. This arrangement allows full viewing of food without depressing tray 22 while better protecting food from accidental spills caused by inadvertant access through the sides of oven 10**.

Figure 9A:
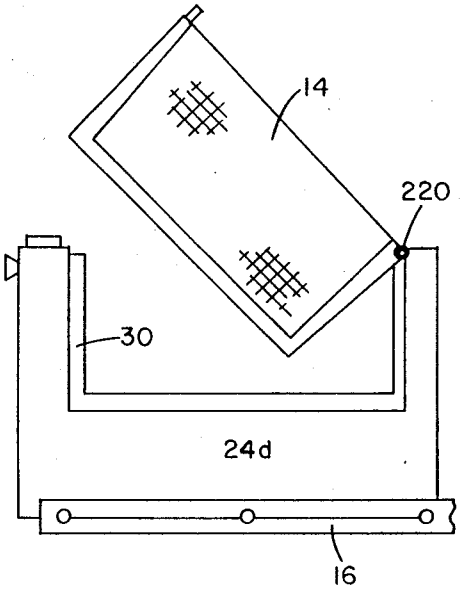
FIGS. 9A and 9B show side views of alternate embodiments of the microwave oven of FIG. 8.

FIG. 9A shows a similar embodiment where cover 14 is as in FIG. 1, so that no transparent panels 230 are required, but cover 14 is hinged at the rear.

Figure 9B:
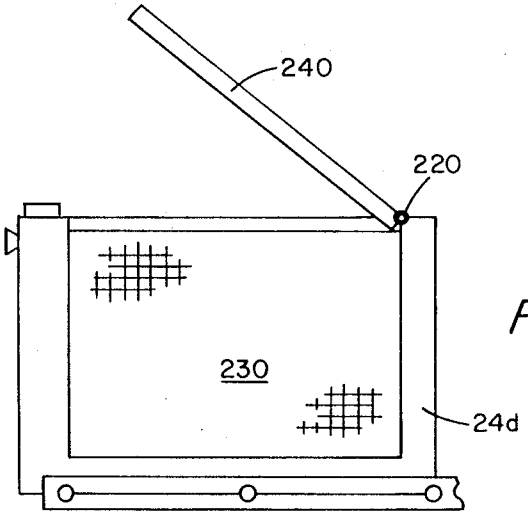

FIG. 9B is another example of how transparent sides 230 may extend completely from near tray 22 to near top surface 44. Cover 14 can be made planar in this arrangement and thus less expensively, but less access to cavity 20 is available.

Of course, the smaller covers 14 shown in FIGS. 8 and 9B can be slidably mounted.

It can now be understood how the various embodiments described above achieve the objects and advantages sought after. It will now be evident to those of skill in the art that other embodiments incorporating these features and advantages exist. It is thus intended that this invention not be restricted to the disclosed embodiments but rather be limited only by the spirit and the scope of the claims that follow.

What is claimed is:

1. A microwave oven, comprising:

cavity bottom means, having at least two opposing parallel sides defining the bottom of a microwave oven cavity;

radio frequency energy means, coupled to the cavity bottom means, for providing energy to the microwave oven cavity;

cover means having a surface defining the ceiling of the microwave oven cavity, said cover means being horizontally slidable with respect to the cavity bottom means along at least one of the opposing parallel sides, for selectively closing or opening the microwave oven cavity;

front panel means, disposed perpendicularly to the cavity bottom means along a front edge of the cavity bottom means, for further enclosing the microwave oven cavity; and ducting means, disposed within the front panel means, for venting the cavity by providing pressurized air to the cavity.

2. The microwave oven as in claim further comprising means coupled to said cavity bottom means for selectively sliding said microwave oven into and out of an under-counter kitchen cabinet.

3. The microwave oven as in claim 1 further comprising means coupled to said cavity bottom means for mounting said microwave oven to a kitchen cabinet drawer.

4. The microwave oven as in claim 1 further comprising interlock means, disposed adjacent the cover means and coupled to the cavity bottom means, for enabling the radio frequency energy means, only when the cover means and the cavity bottom means enclose the cavity.

5. The microwave oven as in claim 1 further comprising means, peripherally disposed about the bottom member, for containing food spilled in the cavity.

6. A microwave oven comprising:

cavity bottom means, having at least two opposing parallel sides defining the bottom of a microwave oven cavity;

radio frequency energy means, coupled to the cavity bottom means, for providing energy to the microwave oven cavity;

cover means having a surface defining the ceiling of the microwave oven cavity, said cover means being horizontally slidable with respect to the cavity bottom means along at least one of the opposing parallel sides, for selectively closing or opening the microwave oven cavity;

means, peripherally disposed about the cavity bottom means for choking radio frequency energy between the cavity bottom means and the horizontally slidable cover means; and means coupled to said bottom means for selectively sliding said microwave oven into and out of an under-counter kitchen cabinet.

7. The microwave oven as in claim wherein the choking means further comprises a reentrant choke cavity having a slotted common wall.

8. A microwave oven comprising:

cavity bottom means, having at least two opposing parallel sides defining the bottom of a microwave oven cavity;

ratio frequency energy means, coupled to the cavity bottom means, for providing energy to the microwave oven cavity;

cover means having a surface defining the ceiling of the microwave oven cavity, said cover means being horizontally slidable with respect to the cavity bottom means along at least one of the opposing parallel sides, for selectively closing or opening the microwave oven cavity;

means, peripherally disposed about the cavity bottom means for choking radio frequency energy, said choking means comprising a reentrance choke cavity having a slotted common wall; and choke cover means, disposed adjacent the slotted common wall and transparent to the energy provided by the radio frequency energy means, for easing friction between the cavity bottom means and the horizontally slidable cover means.

9. A microwave oven comprising:

cavity bottom means, having at least two opposing parallel sides defining the bottom of a microwave oven cavity;

ratio frequency energy means, coupled to the cavity bottom means, for providing energy to the microwave oven cavity;

cover means having a surface defining the ceiling of the microwave oven cavity, said cover means being horizontally slidable with respect to the cavity bottom means along at least one of the opposing parallel sides, for selectively closing or opening the microwave oven cavity;

means, peripherally disposed about the cavity bottom means for choking radio frequency energy, said choking means comprises a reentrant choke cavity having a slotted common wall; and choke cover means, disposed adjacent the slotted common wall and transparent to the energy provided by the radio frequency energy means, for regulating the spacing between the cavity bottom means and the horizontally slidable cover means.

10. A microwave oven comprising:

a bottom member, having a horizontal bottom panel and two opposing vertical side panels attached to the bottom panel;

microwave energy means, coupled to the bottom member, for providing radio frequency energy sufficient to cook food;

a front member, coupled to the bottom member perpendicular to the opposing side panels, and extending above the bottom member;

a canopy, having an arch-shaped cross-section, with opposing parallel sides and defining a conductive bounded cavity with the bottom member and the front member, said horizontal bottom panel defining the floor of said microwave oven cavity;

means slidably mounting each of the opposing sides of the canopy to a respective one of the opposing side panels for selectively closing or opening the microwave oven cavity by sliding said canopy in a horizontal direction with respect to said bottom member; and means coupled to said side panels for selectively sliding said microwave oven into and out of an undercounter kitchen cabinet.

11. The microwave oven as in claim 10, wherein the canopy comprises: a a sheet of perforated metal; and a sheet of light transparent resilient polymer.

12. The microwave oven as in claim 11 wherein the canopy further comprises a metallic back member extending between the opposing parallel sides and disposed in parallel with the front member, and further defining the conductive bounded cavity.

13. The microwave oven as in claim 11 further comprising a back member, disposed adjacent and perpendicular the opposing upstanding side panels, and parallel to the front member, and further defining the conductive bounded cavity.

14. The microwave oven as in claim 10 further comprising choke means, peripherally disposed along the upstanding side panels and the front member, for stopping radio frequency energy from escaping the cavity around the slidably mounted canopy.

15. The microwave oven as in claim 10 further comprising fan means, disposed adjacent the bottom member, for providing pressurized air flow to cool said microwave energy means.

16. A microwave oven comprising:

a bottom member, having a hoizontal bottom panel and two opposing vertical side panels attached to the bottom panel;

microwave energy means, coupled to the bottom member, for providing radio frequency energy sufficient to cook food;

a front member, coupled to the bottom member perpendicular to the opposing side panels, and extending above the bottom member;

a canopy, having an arch-shaped cross-section, with opposing parallel sides and defining a conductive bounded cavity with the bottom member and the front member, said horizontal bottom panel defining the floor of said microwave oven cavity;

means slidably mounting each of the opposing sides of the canopy to a respective one of the opposing side panels for selectively closing or opening the microwave oven cavity by sliding said canopy in a horizontal direction with respect to said bottom member;

fan means, disposed adjacent the bottom member, for providing pressurized air flow to cool said microwave energy means; and ducting means, disposed adjacent the bottom member and the front member, for venting the cavity by providing and removing pressurized air to and from the cavity.

17. A microwave oven comprising:

a bottom member, having a horizontal bottom panel and two opposing vertical side panels attached to the bottom panel;

microwave energy means, coupled to the bottom member, for providing radio frequency energy sufficient to cook food;

a front member, coupled to the bottom member perpendicular to the opposing side panels, and extending above the bottom member;

a canopy, having an arch-shaped cross-section, with opposing parallel sides and defining a conductive bounded cavity with the bottom member and the front member, said horizontal bottom panel defining the floor of said microwave oven cavity;

means slidably mounting each of the opposing sides of the canopy to a respective one of the opposing side panels for selectively closing or opening the microwave oven cavity by sliding said canopy in a horizontal direction with respect to said bottom member; and tray means, disposed perpendicular to and along the front member and the upstanding side panels, peripherally disposed about the bottom member, transparent to the radio frequency energy provided by the microwave energy means, for supporting food to be cooked and for containing spills.

18. The microwave oven as in claim 17 where the tray means comprises:

a collar, peripherally connected about the upstanding side panels and the front panel, having a lip disposed below a point where the collar connects the side panels and the front panel; and a ceramic plate, connected to the collar at the lip.

19. A microwave oven, comprising:

a horizontally oriented bottom member;

a canopy-shaped cover, having an arch shaped cross-section and defining a conductive bounded cavity with the bottom member;

means for hinging the cover to the bottom member;

radio frequency energy means, coupled to the cavity bottom means, for providing energy to the microwave oven cavity;

front panel means, disposed perpendicularly to the cavity bottom means along a front edge of the cavity bottom means, for further enclosing the microwave oven cavity; and ducting means, disposed within the front panel means, for venting the cavity by providing pressurized air to the cavity.

20. The microwave oven as in claim 19 wherein the cavity bottom means further comprises means coupled to the cavity bottom means for selectively sliding the microwave oven into and out of an under-counter kitchen cabinet.

21. The microwave oven as in claim 19 wherein the cavity bottom means further comprises means coupled to the cavity bottom means for mounting the microwave oven on a kitchen cabinet drawer.

* * * * *